US007354329B2

(12) United States Patent
Derraa

(10) Patent No.: US 7,354,329 B2
(45) Date of Patent: Apr. 8, 2008

(54) METHOD OF FORMING A MONOLITHIC BASE PLATE FOR A FIELD EMISSION DISPLAY (FED) DEVICE

(75) Inventor: Ammar Derraa, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 11/207,010

(22) Filed: Aug. 17, 2005

(65) Prior Publication Data

US 2005/0287898 A1 Dec. 29, 2005

Related U.S. Application Data

(63) Continuation of application No. 09/251,172, filed on Feb. 17, 1999, now abandoned.

(51) Int. Cl.
*H01J 9/00* (2006.01)
*H01J 9/02* (2006.01)

(52) U.S. Cl. ..... 445/24; 445/50; 445/51

(58) Field of Classification Search ..... 445/24; 315/169.2–169.4; 313/495–497; 345/1.3, 345/75.2, 204

See application file for complete search history.

(56) References Cited

U.S. PATENT DOCUMENTS 4,808,983 A * 2/1989 Benjamin et al. ..... 345/90
5,408,161 A * 4/1995 Kishino et al. ..... 313/495
5,487,143 A 1/1996 Southgate ..... 395/157
5,550,435 A 8/1996 Kuriyama et al. ..... 315/169.1
5,563,470 A 10/1996 Li ..... 313/496
5,577,944 A 11/1996 Taylor ..... 445/25
5,598,057 A 1/1997 Vickers ..... 313/495
5,655,940 A * 8/1997 Hodson et al. ..... 445/24
5,661,531 A 8/1997 Greene et al. ..... 349/73
5,663,608 A 9/1997 Jones et al. ..... 313/309
5,688,708 A 11/1997 Kato
5,689,278 A 11/1997 Barker et al. ..... 345/74
5,727,977 A 3/1998 Maracas et al. ..... 445/24
5,754,148 A 5/1998 Kishino et al. ..... 345/74
5,754,149 A 5/1998 Browning et al. ..... 345/75
5,760,535 A 6/1998 Moyer et al. ..... 313/309
5,763,997 A 6/1998 Kumar ..... 313/495
5,767,619 A 6/1998 Tsai et al. ..... 313/495
5,805,117 A 9/1998 Mazurek et al. ..... 345/1
5,872,019 A * 2/1999 Lee et al. ..... 438/20
6,219,022 B1 * 4/2001 Yamazaki et al. ..... 345/103
6,255,769 B1 * 7/2001 Cathey et al. ..... 313/422
6,326,221 B1 12/2001 Lee et al. ..... 438/20
6,421,041 B2 * 7/2002 Yamazaki et al. ..... 345/103

* cited by examiner

*Primary Examiner*—Mariceli Santiago
(74) *Attorney, Agent, or Firm*—Wells St. John, P.S.

(57) ABSTRACT

A substrate is provided and is configurable into a base plate for a field emission display. A plurality of discrete, segmented regions of field emitter tips are formed by at least removing portions of the substrate. The regions are electrically isolated into separately-addressable regions. In another embodiment, a plurality of field emitters are formed from material of the substrate and arranged into more than one demarcated, independently-addressable region of emitters.

37 Claims, 2 Drawing Sheets

METHOD OF FORMING A MONOLITHIC BASE PLATE FOR A FIELD EMISSION DISPLAY (FED) DEVICE

RELATED PATENT DATA

This patent resulted from a continuation application of and claims priority to U.S. patent application Ser. No. 09/251,172, filed Feb. 17, 1999 now abandoned, entitled "Field Emission Display Methods", naming Amman Derraa as inventor, the disclosure of which is incorporated herein by reference.

PATENT RIGHTS STATEMENT

This invention was made with Government support under Contract No. DABT63-97-C-0001 awarded by Advanced Research Projects Agency (ARPA). The Government has certain rights in this invention.

TECHNICAL FIELD

This invention relates to methods of forming a base plate for a field emission display (FED) device, to methods of forming a field emission display (FED) device, to base plates for field emission display (FED) devices, and to field emission display (FED) devices.

BACKGROUND OF THE INVENTION

Flat-panel displays are widely used to visually display information where the physical thickness and bulk of a conventional cathode ray tube is unacceptable or impractical. Portable electronic devices and systems have benefited from the use of flat-panel displays, which require less space and result in a lighter, more compact display system than provided by conventional cathode ray tube technology.

The invention described below is concerned primarily with field emission flat-panel displays or FEDs. In a field emission flat-panel display, an electron emitting cathode plate is separated from a display face or face plate at a relatively small, uniform distance. The intervening space between these elements is evacuated. Field emission displays have the outward appearance of a CRT except that they are very thin. While being simple, they are also capable of very high resolutions. In some cases they can be assembled by use of technology already used in integrated circuit production.

Field emission flat-panel displays utilize field emission devices, in groups or individually, to emit electrons that energize a cathodoluminescent material deposited on a surface of a viewing screen or display face plate. The emitted electrons originate from an emitter or cathode electrode at a region of geometric discontinuity having a sharp edge or tip. Electron emission is induced by application of potentials of appropriate polarization and magnitude to the various electrodes of the field emission device display, which are typically arranged in a two-dimensional matrix array.

Field emission display devices differ operationally from cathode ray tube displays in that information is not impressed onto the viewing screen by means of a scanned electron beam, but rather by selectively controlling the electron emission from individual emitters or select groups of emitters in an array. This is commonly known as "pixel addressing." Various displays are described in U.S. Pat. Nos. 5,655,940, 5,661,531, 5,754,149, 5,563,470, and 5,598,057 the disclosures of which are incorporated by reference herein.

FIG. 1 illustrates a cross-sectional view of an exemplary field emission display (FED) device 10. Device 10 comprises a face plate 12, a base plate 14, and spacers 16 extending between base plate 14 and face plate 12 to maintain face plate 12 in spaced relation relative to base plate 14. Face plate 12, base plate 14 and spacers 16 can comprise, for example, glass. Phosphor regions 18, 20, and 22 are associated with face plate 12, and separated from face plate 12 by a transparent conductive layer 24. Transparent conductive layer 24 can comprise, for example, indium tin oxide or tin oxide. Phosphor regions 18, 20, and 22 comprise phosphor-containing masses. Each of phosphor regions 18, 20, and 22 can comprise a different color phosphor. Typically, the phosphor regions comprise either red, green or blue phosphor. A black matrix material 26 is provided to separate phosphor regions 18, 20, and 22 from one another.

Base plate 14 has emitter regions 28, 30 and 32 associated therewith. The emitter regions comprise emitters or field emitter tips 34 which are located within radially symmetrical apertures 36 (only some of which are labeled) formed through a conductive gate layer 38 and a lower insulating layer 40. Emitters 34 are typically about 1 micron high, and are separated from base plate 14 by a conductive layer 42. Emitters 34 and apertures 36 are connected with circuitry (not shown) enabling column and row addressing of the emitters 34 and apertures 36, respectively.

A voltage source 44 is provided to apply a voltage differential between emitters 34 and surrounding gate apertures 36. Application of such voltage differential causes electron streams 46, 48, and 50 to be emitted toward phosphor regions 18, 20, and 22 respectively. Conductive layer 24 is charged to a potential higher than that applied to gate layer 38, and thus functions as an anode toward which the emitted electrons accelerate. Once the emitted electrons contact phosphor dots associated with regions 18, 20, and 22 light is emitted. As discussed above, the emitters 34 are typically matrix addressable via circuitry. Emitters 34 can thus be selectively activated to display a desired image on the phosphor-coated screen of face plate 12.

The face plate typically has red, green and blue phosphor regions with black matrix areas 26 surrounding the phosphor regions. The three phosphor colors (red, green, and blue) can be utilized to generate a wide array of screen colors by simultaneously stimulating one or more of the red, green and blue regions.

As displays such as the one described above continue to grow in size and complexity, challenges are posed with respect to their design. For example, small-sized FED devices typically have a high resolution. As such displays grow in size, such resolution is desired to be maintained or even improved, yet challenges exist because of the increased dimensions. One such challenge is manifest in the video rate requirement in larger-area displays. The video rate requirement is typically determined by the RC time constant of the device. Typically, address lines (e.g., row and column address lines) extend the entire length or width dimension respectively, of the addressable matrix of field emitters. Larger displays call for larger matrices. With larger matrices, such address lines can extend for greater lengths. Such greater lengths, accordingly, carry with them higher RC time constants which adversely impact the video rate requirement. Other challenges in the design of the larger-area display will be apparent to those of skill in the art.

One solution which has been proposed in the past (see, e.g. U.S. Pat. No. 5,655,940) is to provide separate emitter plates which are subsequently mounted on a substrate to provide a larger-area display. This approach, however, can be inadequate and can result in much more processing complexity than is desirable. Specifically, multiple emitter plates must be separately formed and positioned relative to one another on a substrate. The plates must be precisely positioned to avoid anomalies in the subsequently rendered image. Needless to say, this can be a time-consuming process and results in more processing complexity than is desirable.

Accordingly, this invention. arose out of concerns associated with providing improved field emission display (FED) devices and methods of forming such devices. This invention also arose out of concerns associated with providing larger-area FED displays with little or no additional processing complexity.

SUMMARY OF THE INVENTION

Methods of forming base plates for field emission display (FED) devices, methods of forming field emission display (FED) devices, and resultant FED base plate and device constructions are described. In one embodiment, a substrate is provided and is configurable into a base plate for a field emission display. A plurality of discrete, segmented regions of field emitter tips are formed by at least removing portions of the substrate. The regions are electrically isolated into separately-addressable regions. In another embodiment, a plurality of field emitters are formed from material of the substrate and arranged into more than one demarcated, independently-addressable region of emitters. Address circuitry is provided and is operably coupled with the field emitters and configured to independently address individual regions of the emitters. In yet another embodiment, a monolithic addressable matrix of rows and columns of field emitters is provided and has a perimetral edge defining length and width dimensions of the matrix. The matrix is partitioned into a plurality of discretely-addressable submatrices of field emitters. Row and column address lines are provided and are operably coupled with the matrix and collectively configured to address the field emitters. At least one of the row or column address lines has a length within the matrix which is sufficient to address less than all of the field emitters which lie in the direction along which the address line extends within the matrix.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
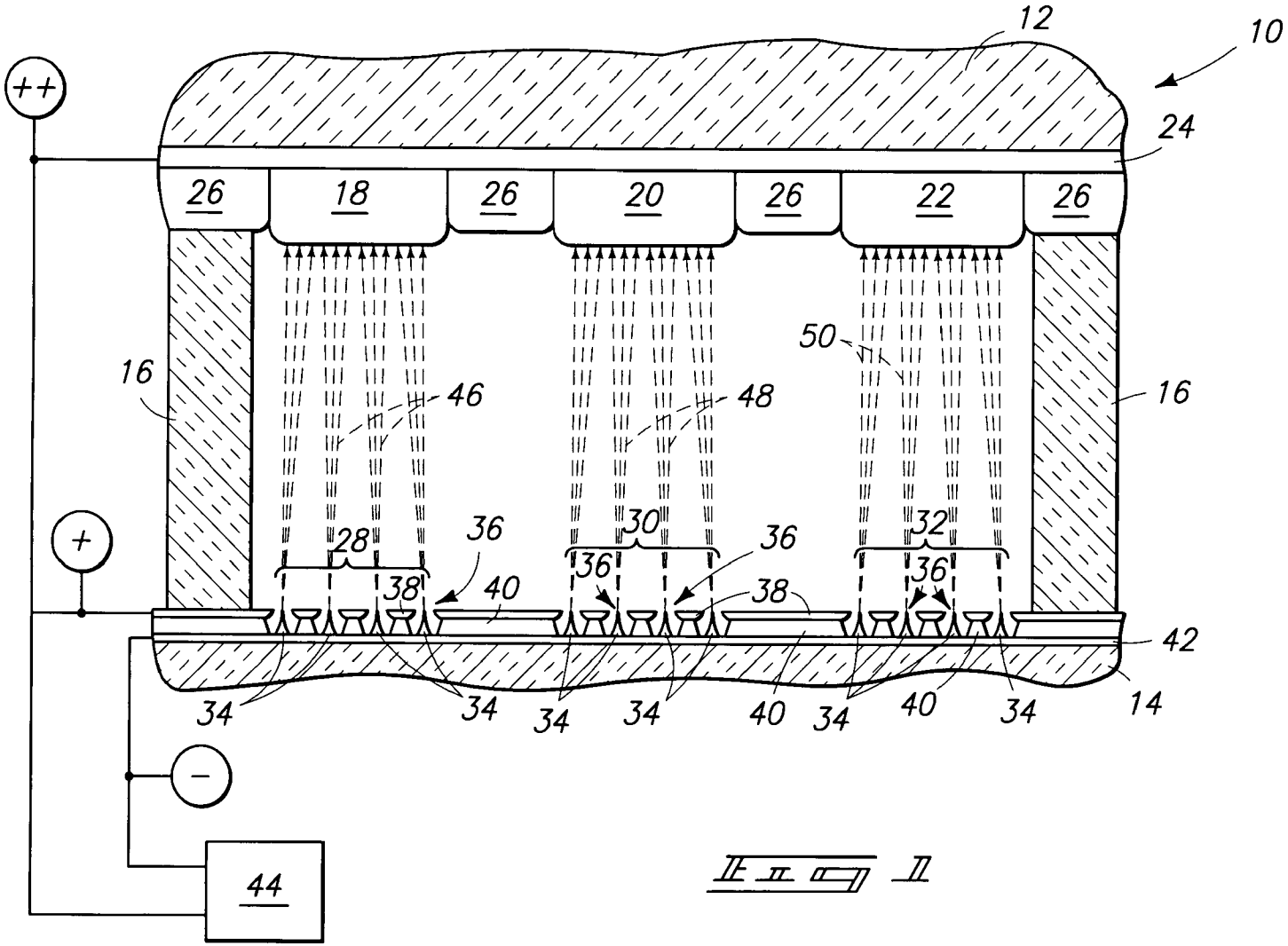
FIG. 1 is a side sectional view of a portion of an exemplary field emission display (FED) device which can be constructed in accordance with one or more embodiments of the present invention.
Figure 2:
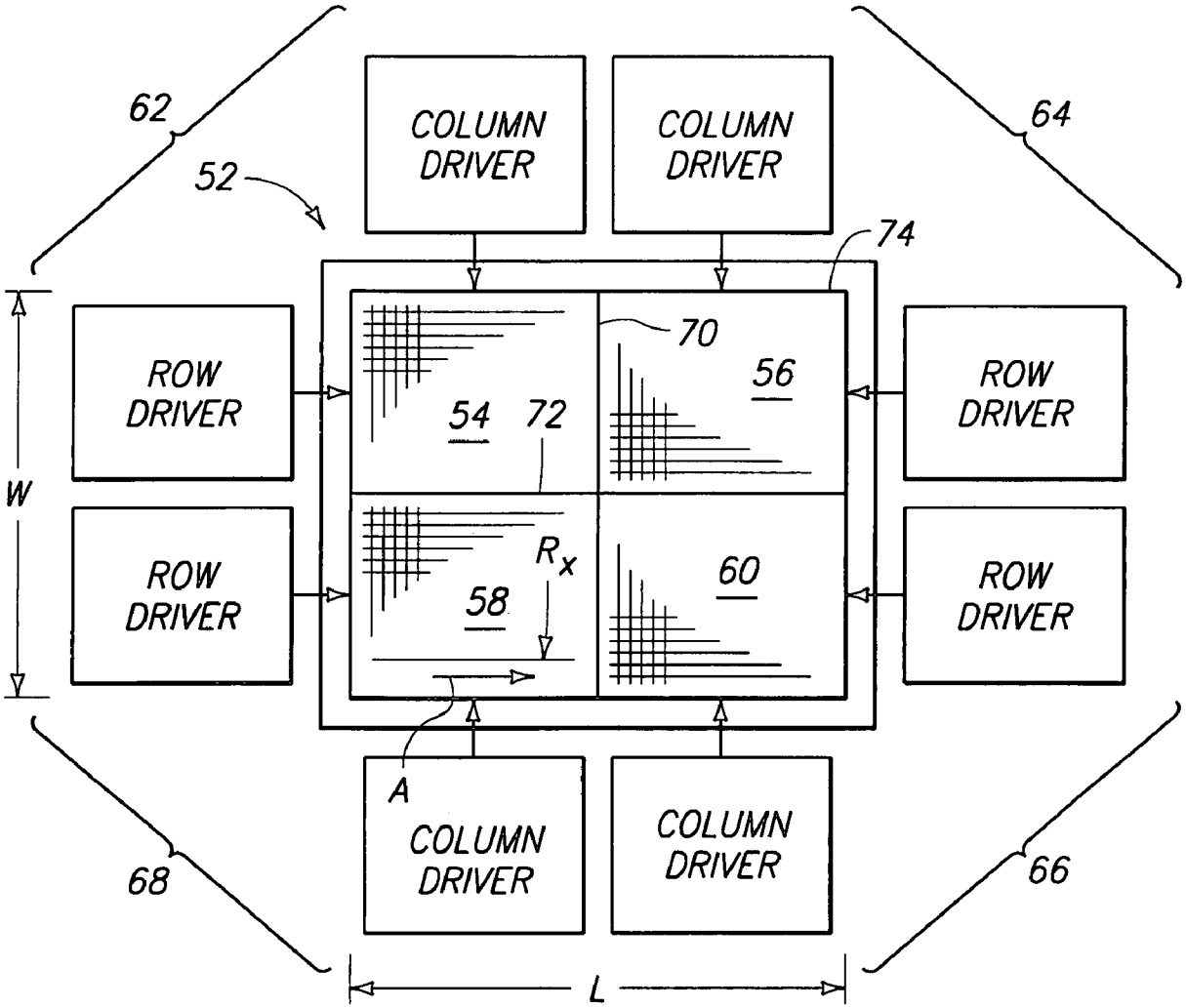
FIG. 2 is a somewhat schematic view of a FED base plate and a address circuitry in accordance with one embodiment of the present invention.

Referring to FIG. 2, and in accordance with one embodiment of the present invention, a substrate 52 is provided and is configurable into a base plate for a field emission display (FED). In the illustrated example, substrate 52 corresponds to base plate 14 of FIG. 1. A plurality of discrete, segmented regions of field emitter tips (such as field emitters or emitter tips 34 in FIG. 1) are formed by removing portions of the substrate, preferably through known etching techniques. Exemplary discrete, segmented regions are shown in FIG. 2 at 54, 56, 58 and 60. In a preferred embodiment, regions 54-60 are electrically isolated from one another into separately-addressable regions of field emitter tips. In the illustrated and preferred embodiment, four regions are formed. It is possible, however, for different numbers of regions to be formed. For example, in one embodiment at least two regions are formed. In another embodiment, at least three regions are formed. More than four regions can be formed, e.g. six, eight, ten, twelve and the like. Additionally, other than even numbers of regions can be formed as, for example, three, five, seven and the like.

In another embodiment, formation of the discrete, segmented regions comprises etching the substrate into the formed regions. In a preferred embodiment, the base plate, as formed, comprises a monolithic base plate of field emitter tips. By providing a monolithic base plate with the plurality of discrete, segmented regions, advantages are achieved over prior devices. For example, the monolithic nature of various of the preferred embodiments can reduce processing complexities by requiring processing of only one work piece, e.g. substrate 52, in order to form the base plate. In addition, resolution of the ultimately-formed device can be improved because of the uniformity of the material from which the base plate is formed. Specifically, by forming the illustrated discrete, segmented, and electrically-isolated regions from a common substrate, uniformity in the ultimately provided image can be enhanced.

In another embodiment, address circuitry is provided and operably coupled with substrate 52. Preferably, the address circuitry is configured to separately address individual regions of the field emitter tips. In the illustrated example of FIG. 2, the address circuitry comprises row drivers and column drivers. Each individual region has its own row driver and column driver. Individual row and column drivers are arranged in groupings designated at 62, 64, 66, and 68 for each individual region. Specifically, the row and column drivers in grouping 62 are provided for addressing region 54; the row and column driver in grouping 64 are provided for addressing region 56; the row and column driver in grouping 66 are provided for addressing region 60; and the row and column driver in grouping 68 are provided for addressing region 58. The individual row and column drivers are connected with individual row and column lines which extend though the individual regions. The row and column lines are typically formed by depositing a conductive material, and then using a photomask to define the conductive line patterns which are subsequently etched from the conductive material. Here, in order to form the separately-addressable regions, the photomask is modified such that the subsequently-etched row and column lines do not extend across the entirety of the addressable matrix, but rather only partially across the matrix in regions corresponding to those illustrated in FIG. 2.

In one embodiment, a face plate, such as face plate 12 in FIG. 1, is provided and supports areas of luminescent material. Exemplary luminescent material areas are shown at 18, 20, and 22. Face plate 12 is preferably mounted in operable proximity with substrate 52 to provide a field emission display (FED) device.

In another embodiment, a plurality of field emitters, such as emitters 34 in FIG. 1, are formed from material of the substrate, which, in this example, corresponds to substrate 14. The emitters are arranged into more than one demarcated, independently-addressable region of emitters. Exemplary demarcated, independently-addressable regions are shown in FIG. 2 at 54, 56, 58, and 60. Demarcation of the individual regions occurs along lines 70, 72. Address circuitry, such as that described above, is preferably provided and operably coupled with the field emitters and configured to independently address the individual regions of emitters. In one embodiment, the emitters are arranged into more than two demarcated, independently-addressable regions of emitters. In another embodiment, the emitters are arranged into more than three demarcated, independently-addressable regions of emitters. In a preferred embodiment, the emitters are arranged into four demarcated, independently-addressable regions of emitters. In the illustrated example, demarcation of the individual regions of emitters takes place by forming address lines, e.g. row and column lines which are effectively contained within the individual respective regions, and which do not extend into any other individual region. Such can be accomplished by using a photomask which defines the individual address lines within each region.

In another embodiment, the arrangement of emitters defines a plurality of rows and columns within each region. In this example, portions of exemplary rows and columns are schematically shown within each of regions 54-60 as cross-hatched areas. In this example, provision of the address circuitry comprises providing at least two separate row drivers for addressing rows in different regions of the emitters. For example, in the illustrated example, region 54 has its own row driver which comprises part of grouping 62. Similarly, region 56 has its own row driver which comprises part of grouping 64. In another embodiment, provision of the address circuitry comprises providing at least two separate column drivers for addressing columns in different regions of the emitters. For example, region 54 has its own column driver which comprises part of grouping 62. Likewise, region 56 has its own column driver which comprises part of grouping 64. In a preferred embodiment, provision of the address circuitry comprises providing at least two separate row drivers and at least two separate column drivers for addressing the rows and columns in different respective regions of the emitters. In the illustrated example, four exemplary regions, i.e. regions 54-60, are provided. Each region has its own row driver and column driver.

In another embodiment, a monolithic addressable matrix of rows and columns of field emitters is provided. In this example, the monolithic addressable matrix corresponds to substrate 52 of FIG. 2. The matrix has a perimetral edge 74 which defines length and width dimensions L, W respectively, of the matrix. The matrix is partitioned into a plurality of discretely-addressable sub-matrices of field emitters. Exemplary sub-matrices are shown at 54, 56, 58, and 60. Row and column address lines are provided and are operably coupled with the matrix. The row and column address lines (shown schematically as cross-hatched areas in each of the regions) are collectively configured to address the field emitters in each region. At least one of the row or column address lines has a length within the matrix which is, sufficient to address less than all of the field emitters which lie in the direction along which the address line extends within the matrix. As an illustrative example, consider row address line $R_x$ in sub-matrix 58. Row address line $R_x$ extends in a direction A within the matrix defined by perimetral edge 74. Row address line $R_x$ has a length within the matrix defined by the perimetral edge which is sufficient to address less than all of the field emitters which lie in the direction along which line $R_x$ extends within the matrix. Specifically, in this example, row address line $R_x$ can address field emitters only within sub-matrix 58, and not within sub-matrix 60 which lie in a common direction with direction A. The same can be said for the other row address lines and their respective sub-matrices, as well as the other column address lines and their sub-matrices.

In one embodiment, the length of the one row or column address line within the matrix is less than a length (L) or width (W) dimension of the matrix. In another embodiment, the length of the one row or column address line within the matrix is less than a length or width dimension of one of the sub-matrices.

In one embodiment, the partitioning of the matrix comprises partitioning the matrix into more than two sub-matrices. In another embodiment, the matrix is partitioned into more than three sub-matrices. In a preferred embodiment, the matrix is partitioned into four sub-matrices.

In yet another embodiment, a field emission display (FED) face plate comprises a monolithic substrate configured into a base plate for a field emission display (FED). The base plate comprises a plurality of regions of field emitter tips which comprise material of the substrate. Individual regions of the plurality of regions are discrete and electrically isolated from one another and are configured to be separately addressed. An exemplary base plate is shown in FIG. 2 at 52. In one embodiment, the substrate comprises at least two regions of field emitter tips. In another embodiment, the substrate comprises at least three regions of field emitter tips. In a preferred embodiment, the substrate comprises at least four regions of field emitter tips.

Various advantages can be achieved by the embodiments described above. Improvements can be achieved in the refresh rates of the ultimately-formed FED devices which are faster than those of identical displays with non-partitioned base plates. This is because the RC time constant scales linearly with the length of the address lines, i.e. row and column address lines. In addition, larger displays can be constructed for applications where a large viewing area is desired, such as an engineering work station or for presentations to larger groups of people in a conference room setting. Additionally, higher resolution can be achieved in larger displays which is comparable with the resolution in smaller displays. Moreover, multiple images can be viewed and updated independently of other images.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A field emission display fabrication method comprising:

using a monolithic substrate, forming a plurality of emitters configured to emit electrons responsive to addressing to generate an image;

defining a plurality of emitter regions with respect to the monolithic substrate, wherein the plurality of emitter regions individually comprise a plurality of the emitters and the emitters of individual ones of the emitter regions are substantially electrically isolated from the emitters of respective others of the emitter regions and the emitters of individual ones of the emitter regions are separately addressable independent of the emitters of respective others of the emitter regions; and wherein the forming comprises forming the emitters to individually comprise material of the monolithic substrate.

2. The method of claim 1 further comprising electrically coupling a plurality of address circuits with respective ones of the emitter regions, and wherein the address circuits are individually configured to address only the emitters of the respective one of the emitter regions.

3. The method of claim 2 further comprising providing the address circuits individually configured to provide row and column addressing signals.

4. The method of claim 2 further comprising providing the address circuits individually comprising circuitry external of the monolithic substrate, and wherein the electrically coupling comprises electrically coupling the address circuits with circuitry of the monolithic substrate.

5. The method of claim 1 further comprising providing a luminescent member spaced from and opposite the monolithic substrate to generate the image responsive to receiving the electrons.

6. The method of claim 1 wherein the defining comprises etching material of the monolithic substrate to define the emitter regions.

7. The method of claim 1 wherein the forming comprises etching material of the monolithic substrate to form the emitters.

8. The method of claim 7 wherein the emitters of plural ones of the emitter regions are formed by the etching.

9. The method of claim 7 wherein all of the emitters of all of the emitter regions are simultaneously formed by the etching.

10. The method of claim 1 wherein the emitters of plural ones of the emitter regions are formed to individually comprise the material of the monolithic substrate.

11. The method of claim 1 wherein all of the emitters of all of the emitter regions are formed to individually comprise the material of the monolithic substrate.

12. The method of claim 1 wherein the forming comprises forming using the monolithic substrate comprising a bulk monolithic substrate.

13. The method of claim 12 wherein the forming comprises forming using the bulk monolithic substrate comprising a semiconductive wafer.

14. The method of claim 12 wherein the forming comprises forming the emitters to individually comprise material of the bulk monolithic substrate.

15. The method of claim 1 wherein the forming comprises forming the emitters elevationally over a surface of the monolithic substrate.

16. The method of claim 1 wherein the forming comprises forming the emitters to individually comprise material elevationally over a surface of the monolithic substrate.

17. The method of claim 16 further comprising forming insulative material intermediate the surface of the monolithic substrate and the material of the emitters elevationally over the surface of the monolithic substrate.

18. The method of claim 1 further comprising:

depositing conductive material over the monolithic substrate; and etching the conductive material to simultaneously form a plurality of address lines for addressing the emitters of plural ones of the emitter regions.

19. The method of claim 1 wherein the forming comprises forming using the monolithic substrate comprising glass.

20. The method of claim 1 wherein the forming comprises forming using the monolithic substrate comprising semiconductive material.

21. The method of claim 1 wherein the forming comprises forming using the monolithic substrate to provide a base plate of the field emission display.

22. The method of claim 1 wherein the forming comprises forming all of the emitters of the emitter regions using the monolithic substrate comprising a homogeneous unitary substrate.

23. The method of claim 1 wherein the defined emitter regions are electrically isolated from one another.

24. The method of claim 23 wherein the defining comprises etching the monolithic substrate.

25. The method of claim 1 wherein the forming comprises forming the emitters of all the emitter regions to comprise material of the monolithic substrate which is a single homogeneous unitary substrate.

26. The method of claim 1 wherein the forming comprises forming all of the emitters of all of the emitter regions to comprise material of the monolithic substrate which is a single homogeneous unitary semiconductive substrate.

27. The method of claim 1 wherein the forming comprises forming all of the emitters of all of the emitter regions using the monolithic substrate comprising a single unitary substrate.

28. The method of claim 1 wherein the forming comprises forming all of the emitters of all of the emitter regions using the monolithic substrate comprising a single unitary semiconductive substrate.

29. A field emission display fabrication method comprising:

using a monolithic substrate, forming a plurality of emitters configured to emit electrons responsive to addressing to generate an image; and defining a plurality of emitter regions with respect to the monolithic substrate, wherein the plurality of emitter regions individually comprise a plurality of the emitters and the emitters of individual ones of the emitter regions are substantially electrically isolated from the emitters of respective others of the emitter regions and the emitters of individual ones of the emitter regions are separately addressable independent of the emitters of respective others of the emitter regions;

wherein the defining comprises etching material of the monolithic substrate to define the emitter regions.

30. A field emission display fabrication method comprising:

using a monolithic substrate, forming a plurality of emitters configured to emit electrons responsive to addressing to generate an image; and defining a plurality of emitter regions with respect to the monolithic substrate, wherein the plurality of emitter regions individually comprise a plurality of the emitters and the emitters of individual ones of the emitter regions are substantially electrically isolated from the emitters of respective others of the emitter regions and the emitters of individual ones of the emitter regions are separately addressable independent of the emitters of respective others of the emitter regions;

wherein the forming comprises etching material of the monolithic substrate to form the emitters.

31. The method of claim 30 wherein the emitters of plural ones of the emitter regions are formed by the etching.

32. The method of claim 30 wherein all of the emitters of all of the emitter regions are simultaneously formed by the etching.

33. A field emission display fabrication method comprising:

using a monolithic substrate, forming a plurality of emitters configured to emit electrons responsive to addressing to generate an image; and defining a plurality of emitter regions with respect to the monolithic substrate, wherein the plurality of emitter regions individually comprise a plurality of the emitters and the emitters of individual ones of the emitter regions are substantially electrically isolated from the emitters of respective others of the emitter regions and the emitters of individual ones of the emitter regions are separately addressable independent of the emitters of respective others of the emitter regions;

wherein the forming comprises forming using the monolithic substrate comprising a bulk monolithic substrate;

wherein the forming comprises forming the emitters to individually comprise material of the bulk monolithic substrate.

34. A field emission display fabrication method comprising:

using a monolithic substrate, forming a plurality of emitters configured to emit electrons responsive to addressing to generate an image;

defining a plurality of emitter regions with respect to the monolithic substrate, wherein the plurality of emitter regions individually comprise a plurality of the emitters and the emitters of individual ones of the emitter regions are substantially electrically isolated from the emitters of respective others of the emitter regions and the emitters of individual ones of the emitter regions are separately addressable independent of the emitters of respective others of the emitter regions;

wherein the forming comprises forming the emitters to individually comprise material elevationally over a surface of the monolithic substrate; and forming insulative material intermediate the surface of the monolithic substrate and the material of the emitters elevationally over the surface of the monolithic substrate.

35. A field emission display fabrication method comprising:

using a monolithic substrate, forming a plurality of emitters configured to emit electrons responsive to addressing to generate an image; and defining a plurality of emitter regions with respect to the monolithic substrate, wherein the plurality of emitter regions individually comprise a plurality of the emitters and the emitters of individual ones of the emitter regions are substantially electrically isolated from the emitters of respective others of the emitter regions and the emitters of individual ones of the emitter regions are separately addressable independent of the emitters of respective others of the emitter regions;

wherein the defined emitter regions are electrically isolated from one another;

wherein the defining comprises etching the monolithic substrate.

36. A field emission display fabrication method comprising:

using a monolithic substrate, forming a plurality of emitters configured to emit electrons responsive to addressing to generate an image; and defining a plurality of emitter regions with respect to the monolithic substrate, wherein the plurality of emitter regions individually comprise a plurality of the emitters and the emitters of individual ones of the emitter regions are substantially electrically isolated from the emitters of respective others of the emitter regions and the emitters of individual ones of the emitter regions are separately addressable independent of the emitters of respective others of the emitter regions;

wherein the forming comprises forming the emitters of all the emitter regions to comprise material of the monolithic substrate which is a single homogeneous unitary substrate.

37. A field emission display fabrication method comprising:

using a monolithic substrate, forming a plurality of emitters configured to emit electrons responsive to addressing to generate an image; and defining a plurality of emitter regions with respect to the monolithic substrate, wherein the plurality of emitter regions individually comprise a plurality of the emitters and the emitters of individual ones of the emitter regions are substantially electrically isolated from the emitters of respective others of the emitter regions and the emitters of individual ones of the emitter regions are separately addressable independent of the emitters of respective others of the emitter regions;

wherein the forming comprises forming all of the emitters of all of the emitter regions to comprise material of the monolithic substrate which is a single homogeneous unitary semiconductive substrate.

* * * * *